US005836757A

United States Patent [19]

Long et al.

[11] Patent Number: 5,836,757

[45] Date of Patent: Nov. 17, 1998

[54] LIQUID FUEL LANTERN

[75] Inventors: Norris R. Long, Wichita; Randall L. May, Andover; Franklin T. Schmidt, Mulvane, all of Kans.; Bert D. Heizelman, Tenafly; Paul Lacotta, Glen Rock, both of N.J.; Lance V. Swearingen, Wichita, Kans.; Robert J. Taff, Wichita, Kans.; Robert J. Gross, Wichita, Kans.; Robert O. Van Driest, Wichita, Kans.

[73] Assignee: The Coleman Company, Inc., Witchita, Kans.

[21] Appl. No.: 512,939

[22] Filed: Aug. 9, 1995

Related U.S. Application Data

[63] Continuation-in-part of Ser. No. 281,743, Jul. 28, 1994, Pat. No. 5,533,892.

[51] Int. Cl.[6] ..... F23Q 3/00

[52] U.S. Cl. ..... 431/264; 431/107; 431/123

[58] Field of Search ..... 431/264, 123, 431/107

[56] References Cited

U.S. PATENT DOCUMENTS

| | | | |
|---|---|---|---|
| Re. 29,457 | 10/1977 | Hastings . | |
| 935,241 | 9/1909 | Weyer . | |
| 1,231,715 | 7/1917 | Davis | 431/105 |
| 1,906,255 | 5/1933 | Engh . | |
| 3,363,437 | 1/1968 | Naujoks | 431/109 |
| 3,843,311 | 10/1974 | Nelson . | |
| 4,533,317 | 8/1985 | Addison . | |
| 4,599,683 | 7/1986 | Beckham . | |
| 4,691,136 | 9/1987 | Schmidt . | |
| 4,870,314 | 9/1989 | Hefling . | |
| 4,881,893 | 11/1989 | Mellini . | |
| 5,116,220 | 5/1992 | Kinzel . | |
| 5,533,892 | 7/1996 | Long | 431/264 |

FOREIGN PATENT DOCUMENTS

| | | |
|---|---|---|
| 0 059 153 | 9/1982 | European Pat. Off. . |
| 2030901 | 12/1971 | Germany . |
| 7-25502 | 5/1995 | Japan . |
| 406 879 | 8/1966 | Switzerland . |
| 643638 | 9/1990 | United Kingdom . |

OTHER PUBLICATIONS

Jan., 1993 Dealer Price List for EPIgas lanterns (no date).

1994 Coleman Outdoor Products Catalog, pp. 4, 5, 8, and 9.

*Primary Examiner*—Larry Jones

*Attorney, Agent, or Firm*—Fitzpatrick, Cella, Harper & Scinto

[57] ABSTRACT

A lantern includes an elongated tubular mantle which is attached to a burner assembly by a spring clip and an electronic ignitor for igniting fuel which flows into the mantle. The mantle is surrounded by a globe, and a wire guard surrounds the globe. A ventilator cap is removably attached to the burner assembly and to the wire guard so that the cap, wire guard, and globe can be removed as a unit from the burner assembly. A nut is rotatably captured on the ventilator cap for attaching the ventilator cap to the burner assembly. The fuel tank includes a wide, molded base which provides stable support. An air pump for the fuel tank includes a check valve which automatically opens and closes as air is pumped and a pressure indicator to indicate when the fuel tank reaches operating pressure. The pump is automatically lubricated on each stroke.

38 Claims, 6 Drawing Sheets

FIG. 11
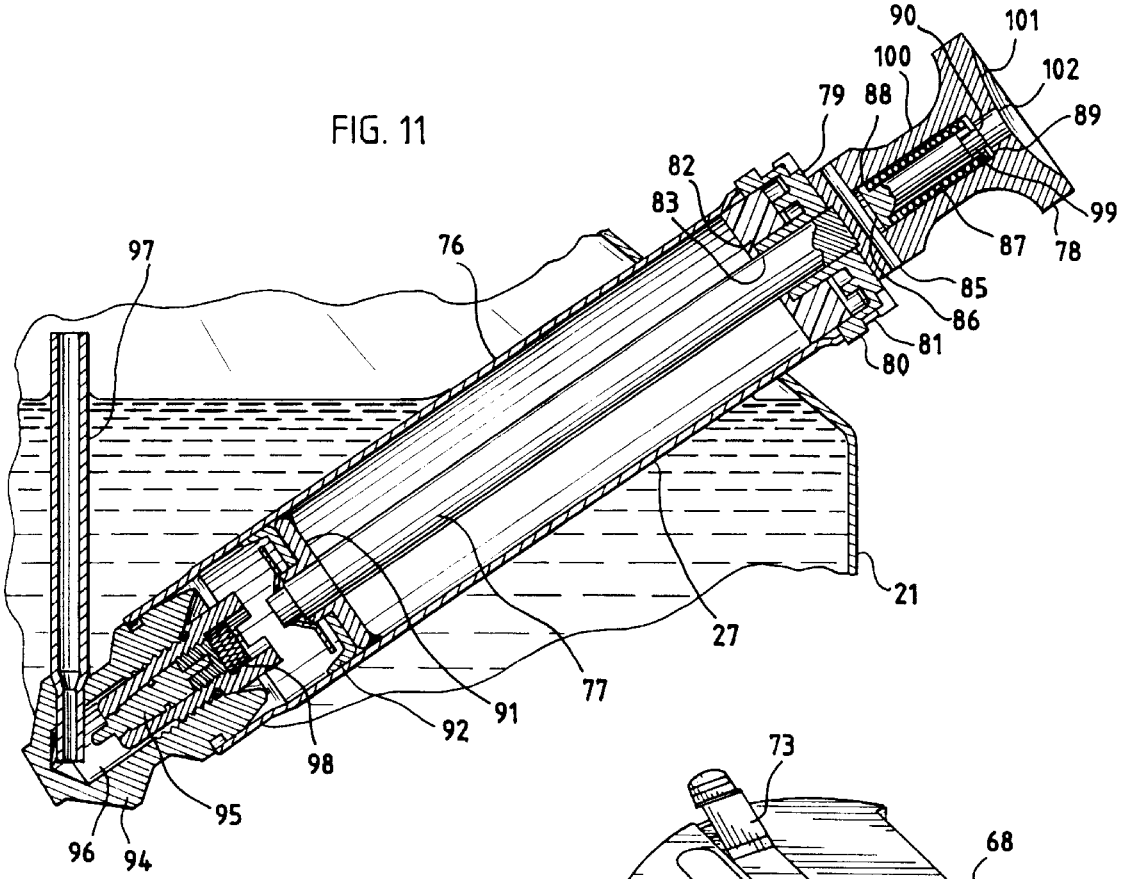
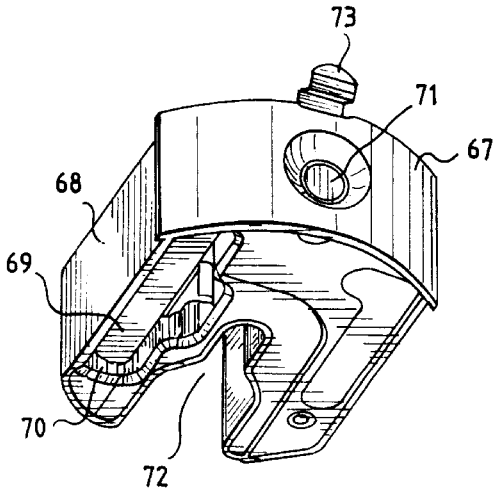
FIG. 12
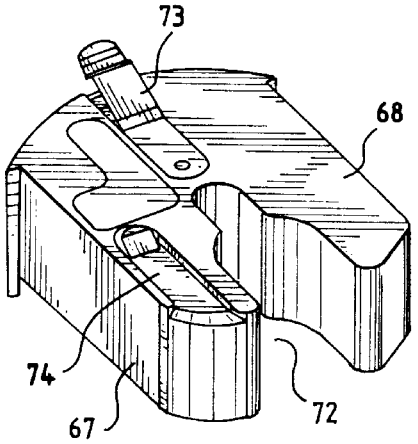
FIG. 13

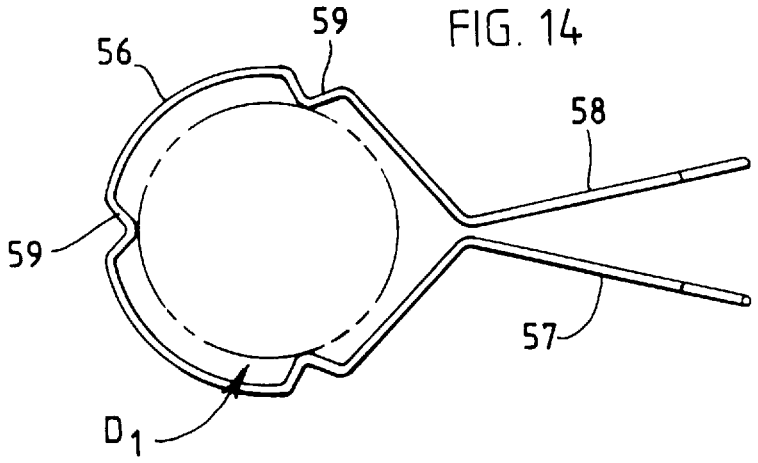
FIG. 14
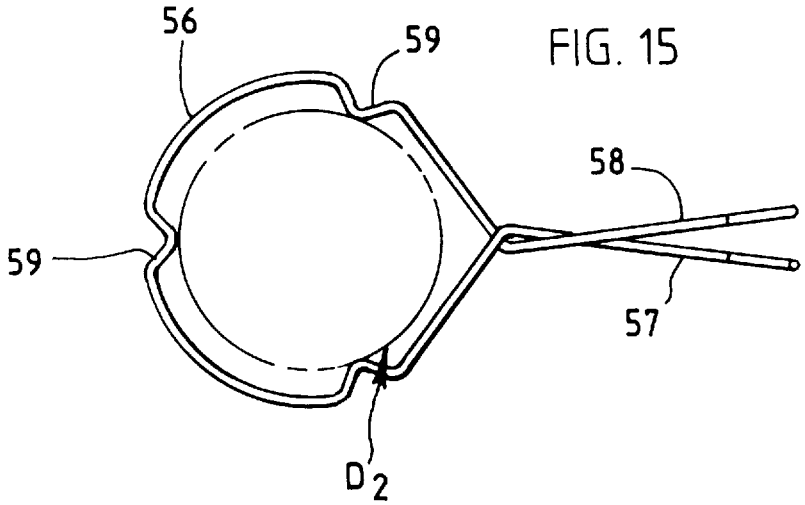
FIG. 15
FIG. 16
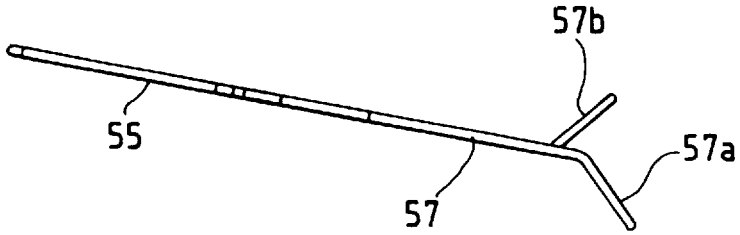

LIQUID FUEL LANTERN

RELATED APPLICATION

This application is a continuation-in-part of copending application entitled "LIQUID FUEL LANTERN WITH ELECTRONIC IGNITION", Ser. No. 08/281,743, filed Jul. 28, 1994 U.S. Pat. No. 5,533,892, issued to Norris R. Long on Jul. 9, 1996.

BACKGROUND

This invention relates to a liquid fuel lantern. Liquid fuel lanterns for camping and outdoor use are well known and are described, for example, in Reissue U.S. Pat. No. 29,457, which is owned by The Coleman Company, Inc. Liquid fuel which is used in such lanterns can be Coleman fuel, white gas, unleaded gasoline, etc.

In conventional liquid fuel lanterns such as the ones which Coleman has offered for many years, fuel is contained in a pressure vessel or fuel tank into which air is pumped under pressure. A dip tube or fuel pickup tube extends to nearly the bottom of the tank, and the upper end of the dip tube is connected through a valve system to a generator. The generator is a metal tube which passes into a venturi tube which is connected to one or more catalytic mantles. Fuel is discharged at high velocity from an orifice at the end of the generator into the venturi where air is aspirated and mixed and fed to the catalytic mantle as a combustible mixture for burning.

U.S. Pat. Nos. 4,870,314, 4,691,136, and 3,843,311 describe propane or LP lanterns which are equipped with piezoelectric ignition devices. Rather than using a lighted match, the LP gas is ignited by a spark adjacent the mantle which is generated by the piezoelectric device.

Liquid fuel lanterns are more difficult to light than LP lanterns. LP gas is gaseous at atmospheric pressure and temperature and is easily ignited by a spark, even under cold conditions.

On the other hand, liquid fuel is a liquid at atmospheric pressure and temperature. It is therefore more difficult to provide automatic spark ignition of the fuel/air mixture of a liquid fuel appliance, especially under cold conditions. As the fuel/air mixture flows into the mantle, it mixes with more air which makes the fuel mixture leaner. The lean fuel mixture is more difficult to light with a sparking device, and the difficulty increases as the ambient temperature decreases.

Co-owned U.S. Pat. application entitled "LIQUID FUEL LANTERN WITH ELECTRONIC IGNITION," U.S. Pat. No. 5,533,892, describes a liquid fuel lantern which includes a pilot tube so that the lantern can be easily ignited by a sparking device. The pilot tube conveys fuel directly from the burner assembly to the ignition device, and the fuel which flows out of the pilot tube is richer than the fuel which flows out of the burner and reaches the ignition device. The spark ignites a flame at the end of the pilot tube, and the flame ignites the fuel which flows out of the burner into the mantle.

The mantles which have heretofore been used with both liquid fuel and LP lanterns are typically sock-type. Such mantles are shaped like a small bag with one open end. The open end is secured around the outlet end of the burner tube by a drawstring or a metal clip. U.S. Pat. No. 5,116,220 describes a flexible metal clip for securing a mantle on a burner tube. When the ends of the clip are squeezed together, the diameter of the bight portion increases. Rosette mantles are also sometimes used. The rosette mantles, are about the same length as sock-type mantles but are open at both ends. After initial burnoff or sintering, the rosette mantles assume a spherical shape and have performance characteristics similar to sock-type mantles.

Lanterns which use either liquid fuel or LP fuel conventionally include a transparent globe which surrounds the burner assembly and a ventilator cap which covers the globe. The ventilator cap is usually connected to the burner assembly by a nut. When the mantle must be replaced, the nut is unscrewed, and the ventilator cap and globe are separately removed.

SUMMARY OF THE INVENTION

The invention provides a totally redesigned liquid fuel lantern which includes an elongated tubular mantle which provides better illumination, a spring clip for quickly and easily securing each end of the mantle, a globe/guard/ventilator cap assembly which is removable as a unit for changing the mantle, a removable electronic ignition module, and a novel air pump for the fuel tank. A more detailed explanation of the various aspects of the invention is contained in the description which follows.

DESCRIPTION OF THE DRAWING

The invention will be explained in conjunction with an illustrative embodiment shown in the accompanying drawing, in which

FIG. 11 is a fragmentary sectional view of the air pump for the fuel tank;

FIG. 12 is a perspective view of the front and bottom of the electronic ignition module;

FIG. 13 is a perspective view of the rear and top of the electronic ignition module;

FIG. 14 is a plan view of one of the spring clips for attaching the mantle;

FIG. 15 is a view similar to FIG. 14 showing the spring clip in a restricted condition for attaching the mantle to the burner assembly; and FIG. 16 is a side view of the spring clip.

DESCRIPTION OF SPECIFIC EMBODIMENT

Figure 1:
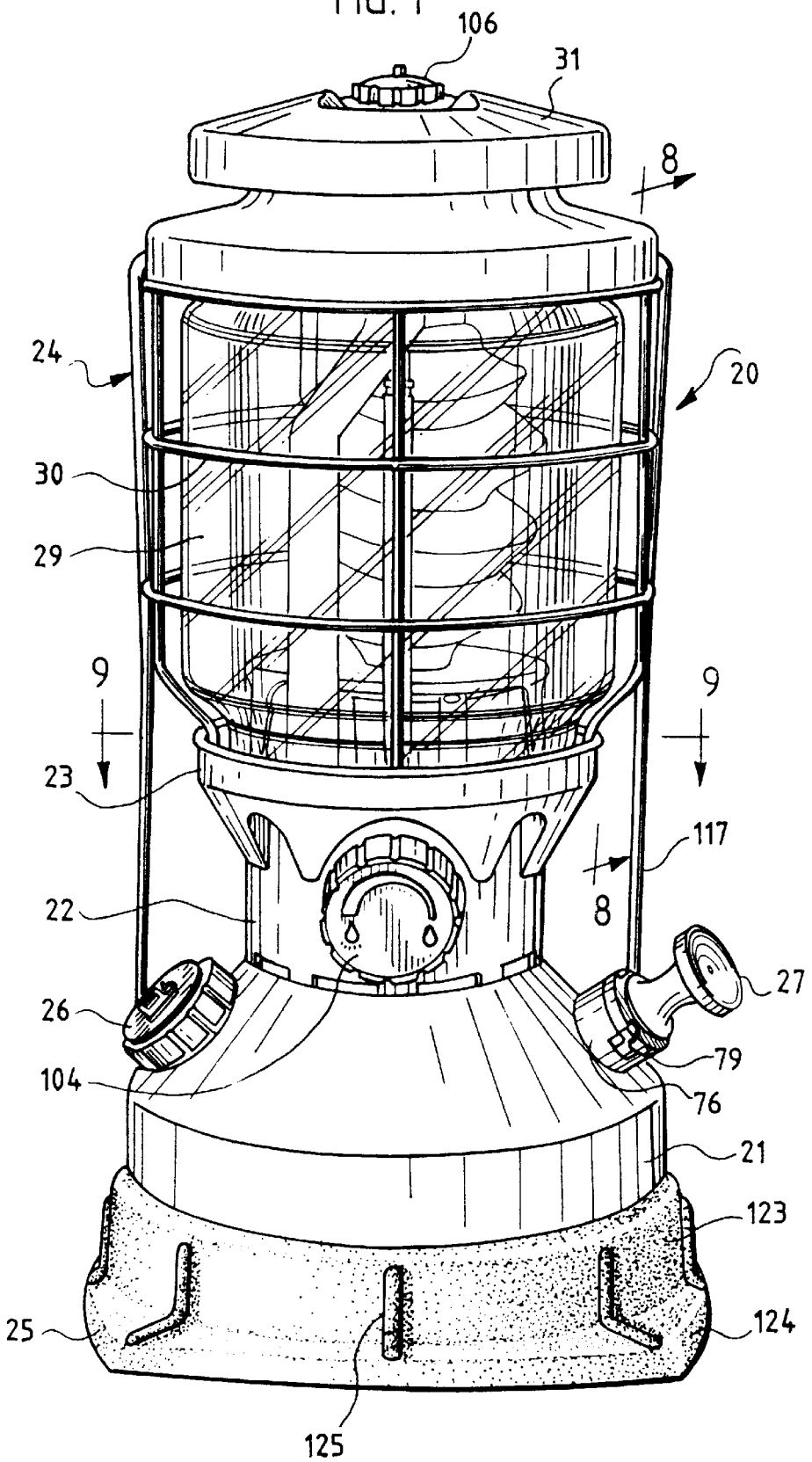
FIG. 1 is a perspective view of a lantern formed in accordance with the invention.

Referring to FIGS. 1 through 4, a liquid fuel lantern 20 includes a fuel tank or fount 21, a cylindrical collar 22 and a burner base 23 which are supported by the fuel tank, and a globe/guard/ventilator cap assembly 24. A molded elastomeric base 25 is secured to the bottom of the fuel tank and extends outwardly therefrom to stabilize the lantern. The fuel tank includes a fill spout which is covered by a removable cap 26 and an air pump 27.

The globe/guard/ventilator cap assembly 24 includes a transparent glass globe 29, a wire rod guard 30, and a ventilator cap 31. The globe 29 surrounds a metal burner assembly 32 (FIGS. 3 and 4) which extends upwardly within the globe and conducts fuel from the fuel tank 21 to an elongated tubular catalytic mantle 33. The burner assembly 32 includes a generator tube 35 which communicates with the fuel tank and an air inlet tube 36. The bottom of the air inlet tube extends through a heat shield plate 37 and a base plate 39 which is supported by the burner base 23, and ambient air can flow into the open bottom end of the air inlet tube through openings in the collar 22. The heat shield plate 37 is supported above the pan 23 by a plurality of legs 38.

The upper end of the generator tube 35 extends through an opening in the inlet tube 36, and a conventional fuel orifice or jet nozzle is mounted on the upper end of the generator. The diameter of the inlet tube is reduced above the fuel jet to provide a venturi which aspirates air into the open bottom end of the inlet tube.

The inlet tube 36 is connected to a generally cylindrical burner top 41. The burner top is formed from an inverted top cup 42 and a bottom plate 43 (FIG. 3) which is crimped around the cup to provide an internal chamber. An outlet tube 44 extends downwardly from the burner top, and an annular fitting 45 (FIG. 4) is secured to the bottom end of the outlet tube. The fitting is provided with an annular groove 46 for supporting one end of the mantle 33. A flash back arrester screen is installed within this fitting. The lower end of the mantle is supported by a plug 47 which is mounted on the heat shield 37. The plug 47 is provided with an annular groove 48 for securing the mantle and a closed top surface 49 which closes the lower end of the mantle.

Figure 3:
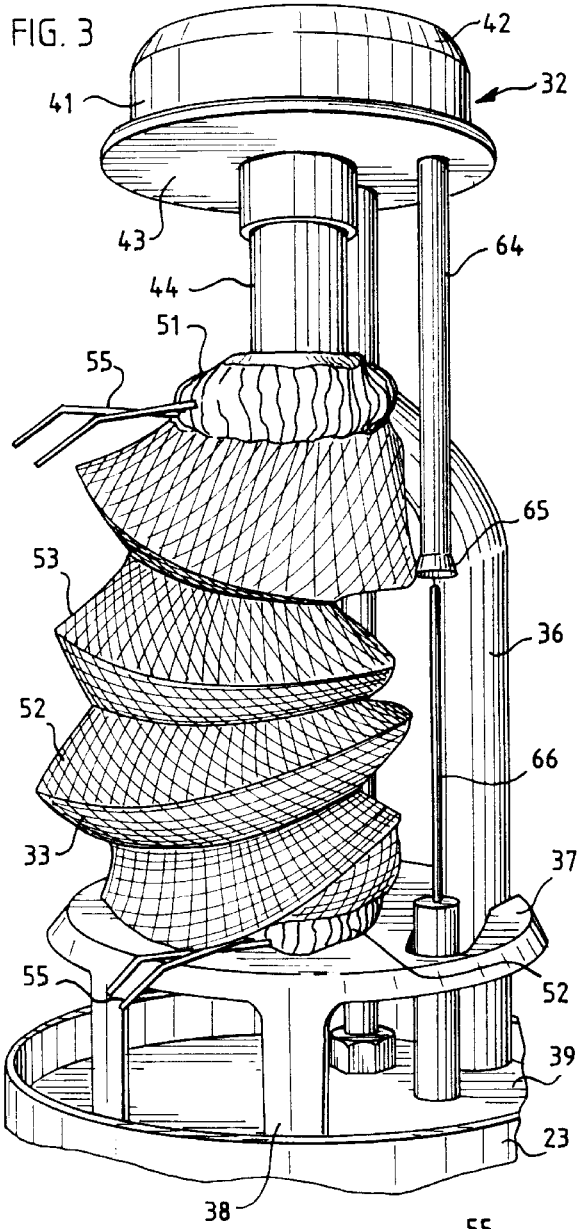
FIG. 3 is an enlarged fragmentary perspective view of the burner assembly of the lantern.
Figure 4:
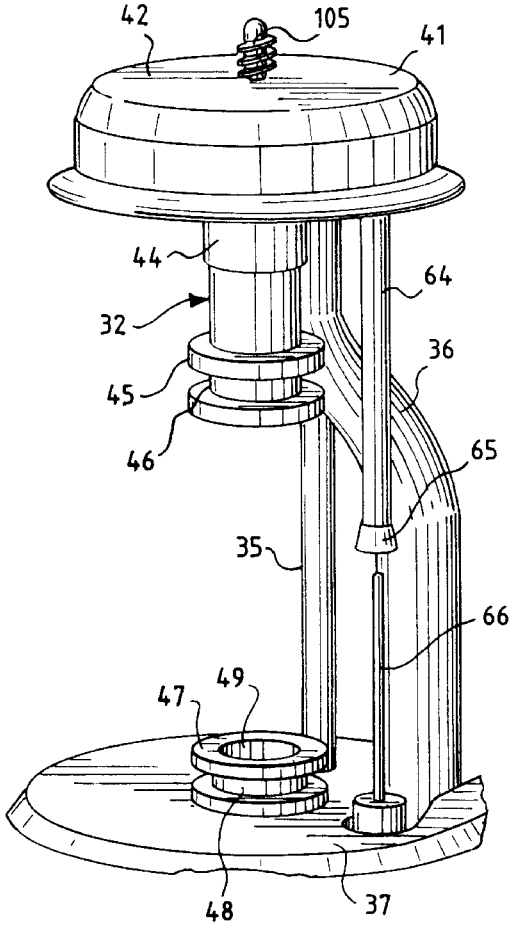
FIG. 4 is a view similar to FIG. 3 with the mantle removed.
Figure 5:
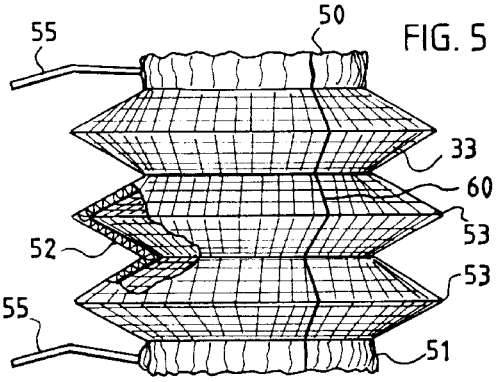
FIG. 5 is a fragmentary elevational view of the mantle.
Figure 6:
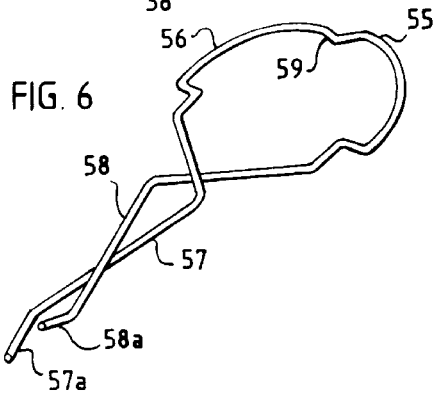
FIG. 6 is a perspective view of one of the spring clips for attaching the mantle.

Referring to FIGS. 3 and 5, the mantle 33, which may be formed from conventional mantle mesh material as described in U.S. Pat. No. 4,533,317, has the shape of an elongated tube with top and bottom open ends 50 and 51. Prior to initial burnoff, the tubular or generally cylindrical side wall 52 of the mantle is provided with a plurality of axially spaced accordion pleats 53. The accordion pleats allow the mantle to be compressed axially for compact packaging and allow the mantle to be extended axially for ease of attachment to the fitting 45 and plug 47. When the mantle is attached to the fitting 45 and plug 47, the length of the mantle is about 3 inches, and the width or diameter of the mantle is about 0.75 inch.

The elongated tubular shape of the mantle enhances uniform and more efficient light emission compared to standard bag-type or rosette mantles. The accordion pleats of the mantle also promote initial burnoff of the mantle. After initial burnoff (sintering), the mantle assumes the desired cylindrical shape. The mantle is illustrated in FIGS. 3 and 5 before initial burnoff.

A resilient wire spring clip 55 (FIGS. 14–16) is attached to each end of the mantle. Each clip includes a generally circular central portion or bight portion 56 and a pair of elongated ends 57 and 58. The end 57 terminates in an end portion 57*a* which is inclined downwardly from the plane of the bight portion, and the end 58 terminates in an end portion 58*a* which is inclined upwardly from the plane of the bight portion. The bight portion includes a plurality of radially inwardly extending V-shaped projections 59 which reduce the area of contact between the mantle and the fitting 45 or the plug 47. The mantle is not pressed against the fitting 45 or plug 47 between the V-shaped projections, and those portions of the mantle are thereby not subjected to the stresses which would otherwise occur when the lantern is subjected to the normal bumps and shocks which occur during use. The durability of the mantle is thereby substantially increased. The clips are attached to the open ends of the mantle by threading each clip in and out of the mesh material of the mantle.

One specific embodiment of a clip 55 was formed from ½hard 302/304 stainless steel wire having a diameter of 0.032 inch.

FIGS. 14–16 illustrate the manner of attaching the clips and the mantle to the fitting 45 and plug 47. FIG. 14 illustrates the clip in a relaxed condition. The ends 57 and 58 are separated, and the inscribed diameter $D_1$ of the projections 59 is slightly larger than the diameter of the fitting 45 and the plug 47. Each open end of the mantle can therefore be easily slipped over the fitting and the plug. The ends 57 and 58 are then squeezed together as shown in FIG. 15 to reduce the inscribed diameter $D_2$ of the V-shaped portions, and the clip is retained in the stressed condition by crossing the ends 57 and 58 over each other. The inscribed diameter $D_2$ is approximately the same as the diameter of the annular grooves 46 and 48 in the fitting 45 and plug 47, and each clip is thereby retained in the annular groove. The inclined end portions 57*a* and 57*b* of the clip ends facilitate squeezing the ends together and crossing the ends over each other. To assist in properly installing the mantle, the side wall of the mantle may be imprinted with an axial stripe 60 (FIG. 5) to ensure that the mantle is not twisted. If twisted, the mantle will assume a spiral shape after sintering which reduces light output durability.

Catalytic mantles are very fragile, and securing the mantle at both ends distributes shock to the mantle between the two fixation points. The tubular mantle therefore not only provides enhanced illumination, but the dual fixation improves durability over such type designs.

The mantle can be removed for replacement by following the reverse procedure. The ends 57 and 58 of each clip are uncrossed to allow the clip to relax. The bight portion enlarges, and the ends of the mantle easily slip off of the fitting 45 and the plug 47.

Figure 7:
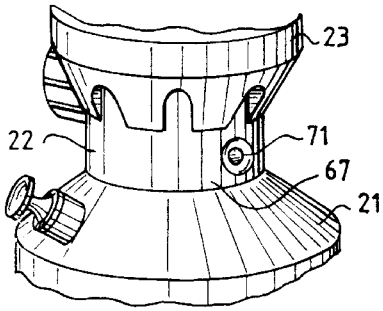
FIG. 7 is a fragmentary perspective view of the electronic ignition module.

A metal pilot tube 64 (FIGS. 2–4) is connected to the bottom plate 43 of the burner top 41 and extends to a position adjacent the mantle 33. The main portion of the pilot tube is cylindrical, and the bottom end is deformed or flattened at 65 to provide an elongated oval opening or slit. An electrode 66 is spaced slightly from the bottom end of the pilot tube to form a spark gap. The electrode is electrically connected to a spark generator module 67 (FIGS. 7, 12, and 13) which is removably mounted within the collar 22.

The spark generator module includes a housing 68 which houses a conventional electronic spark generator. The spark generator is powered by a battery 69 which is inserted into a battery compartment 70 in the housing. The spark generator is actuated by a pushbutton 71 which closes a switch between the battery and the generator, thereby providing a spark between the electrode 66 and the pilot tube 64.

The housing is provided with a U-shaped recess 72. The module is releasably retained within the collar 22 by a spring clip 73 which is secured to the top of the housing 68. A metal contact clip 74 on top of the module electrically connects the spark generator to the electrode 66. Spring clip 73 also provides the ground path for the spark ignition circuit.

This arrangement allows for convenient battery or module replacement in a compact, space-saving manner required in a portable lantern.

Referring to FIG. 11, the air pump 27 for pressurizing the fuel tank includes a cylindrical barrel 76, a pump shaft 77, and a pump knob 78 which is mounted on the outer end of the pump shaft. The shaft extends through a cap 79 which is removably mounted on the barrel by projections 80 which fit into bayonet slots 81 in the barrel. An annular foam pad 82 is mounted between the barrel and an annular sleeve 83 on the cap, and the lower portion of the pad contacts the backing plate 91 of the pump cup 92. The pad is saturated with oil, and the pump cup 92 and backing plate 91 are lubricated on each stroke as they reciprocate within the pad.

The shaft is connected to the knob 78 by a pin 85 which extends through an oversized opening 86 in the shaft. A spring 87 is compressed between an annular shoulder 88 on the shaft and an "E" clip 89 which engages a shoulder 90 on the shaft. As discussed in more detail below the spring is preloaded by compression to allow the end of the pump shaft to extend slightly beyond the upper surface of the pump knob when tank pressure is at or above 20 psi.

A circular backing plate 91 and a flexible pump cup 92 are mounted on the inner end of the shaft 77. The side wall of the pump cup engages the inside surface of the barrel 76.

The inner end of the barrel is closed by a fitting 94, and a check valve 95 which is similar in configuration to a conventional tire valve core or is threadedly mounted in a central bore 96 of the fitting. An outlet tube 97 extends upwardly from the bore toward the top of the fuel tank. The outlet tube extends above the level of the liquid fuel in the tank. A porous filter 98 is mounted between the check valve 95 and the pump cup.

A radial bump on the locking plate extends toward the pump cup and provides a "controlled" leak. When the shaft is forcibly pushed toward the check valve, the pump cup seals tightly against the backing plate, and air is forced through the check valve 95 and into the fuel tank. When the shaft is moved slowly toward the valve, a slight leak exists between the pump cup and the backing plate. The shaft can thereby be pushed toward the check valve until the pump knob 78 abuts the cap 79 so that the pump maintains a compact position when the lantern is being used and/or stored.

The check valve 95 does not need to be opened before pumping or closed after pumping. The check valve includes a conventional spring-biased valve member which opens automatically when the air pressure which is exerted on the check valve is sufficient to overcome the spring force on the valve member. The check valve therefore opens automatically as air is forced into the check valve by the pump cup and closes automatically as the air pressure is relieved.

The operator reciprocates the pump shaft by grasping the side wall 100 of the pump knob 78 between his index and middle fingers and pushing the concave end wall 101 with this thumb. The outer end 102 of the pump shaft 77 is normally maintained flush with the concave end wall 101 by the preload spring 87 which is held between shoulder 88 and "E" clip 89. "E" clip 89 is position in a elongated radial slot 99, the length of which limits the distance within which the end 102 may move. As shown in FIG. 11, the spring forces the shaft to the left against the pin 85. However, when the air pressure within the fuel tank offsets the force of the spring, the shaft 77 is forced slightly to the right relative to the pump knob so that the outer end 102 projects outwardly from the concave surface of the knob. The projecting end of the shaft presses against the operator's thumb and provides a tactile indication that the pressure within the tank has reached proper operating pressure. The actuation of the pressure indicator 102 is controlled by the preload spring 87. In one specific embodiment, the force of the preload spring was overcome when the air pressure within the fuel tank reached 20 psi.

Figure 2:
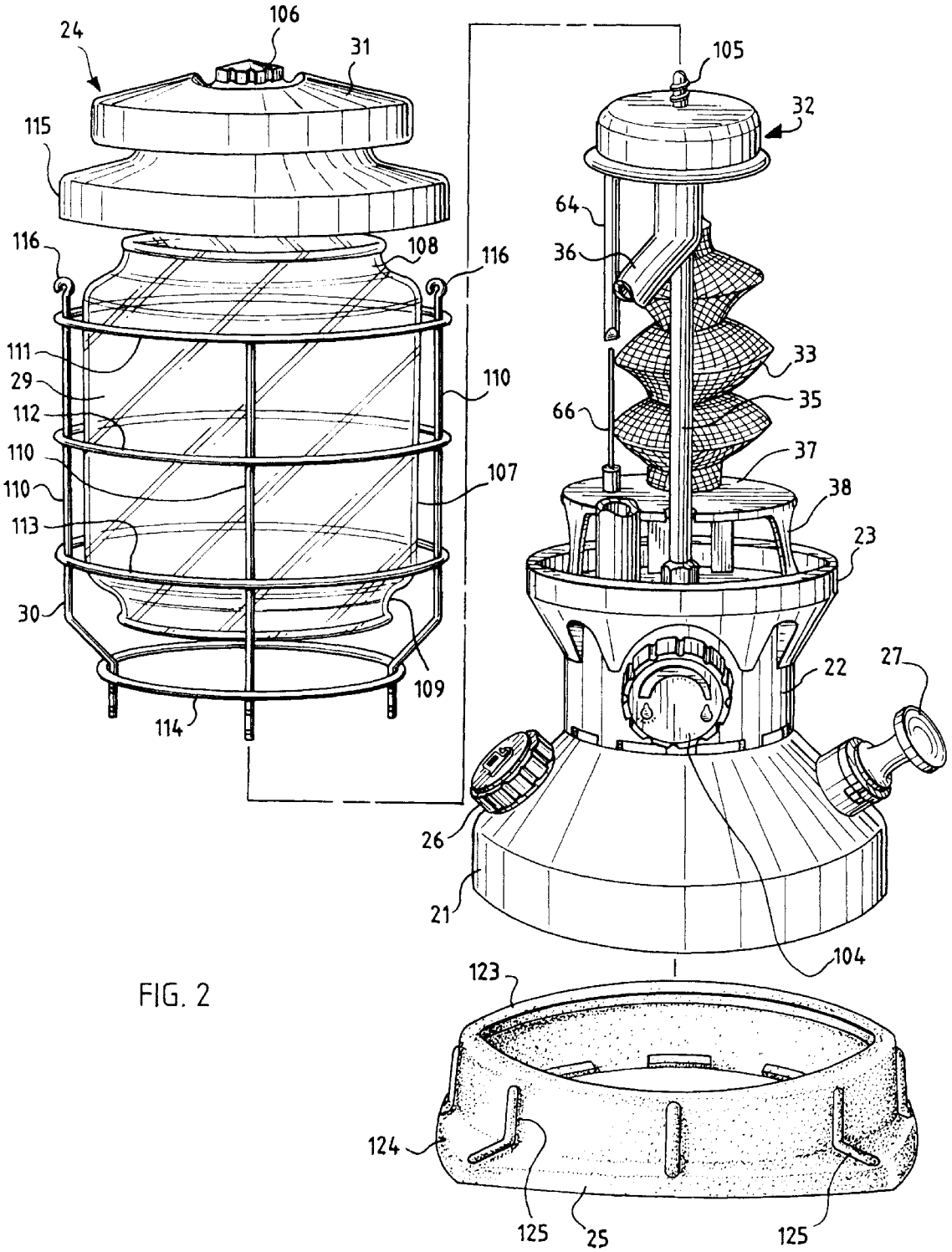
FIG. 2 is an exploded perspective view of the lantern.

After the fuel tank is pressurized, fuel can be forced by the air pressure into the generator by rotating a fuel control knob 104 (FIGS. 1 and 2). The knob operates a conventional fuel valve between the fuel pickup tube in the fuel tank and the generator tube 35. The lantern is preferably equipped with an instant lighting mechanism which is conventional on Coleman lanterns and which enables the liquid fuel to be ignited without priming or preheating. When the fuel valve is opened, the pushbutton 71 of the spark generator module 67 is depressed to create a spark at the outlet end of the pilot tube 64. The fuel/air mixture which flows out of the pilot tube is ignited, and the pilot flame ignites the fuel/air mixture which flows from the outlet tube 44 into the mantle 33. A more detailed description of the operation of the pilot tube during ignition may be found in the aforementioned U.S. patent application Ser. No. 08/281,743, filed Jul. 28, 1994.

The globe/guard/ventilator cap assembly 24 (FIGS. 1 and 2) is supported by the base plate 39 of the burner base 23. The bottom of the globe 29 engages the base plate, and a threaded stud 105 on the top of the burner assembly extends into the opening of a nut 106 on the ventilator cap 31. A plurality of globe support springs are provided between the lower end of the globe and the base plate to allow secondary air for combustion to flow between the base plate and the globe. The support springs also cushion the globe against vertical movement and prevent rattling. The globe/guard/ventilator cap assembly is secured by threading the nut onto the stud 105 to clamp the globe against the base plate 39. The nut is rotatably captured within an opening in the top of the ventilator cap so that the nut is retained in the cap and will not be lost when the nut is unscrewed.

Figure 8:
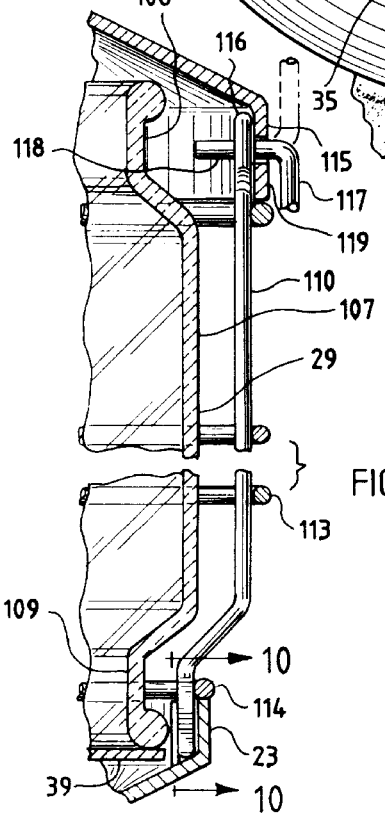
FIG. 8 is a fragmentary sectional view taken along the line 8—8 of FIG. 1.

The globe 29 includes a cylindrical central portion 107 and upper and lower reduced diameter end portions or necks 108 and 109 (see also FIG. 8).

The guard 30 is formed by four vertical wire rods 110 and four circular wire rods 111–114. The vertical rods extend generally parallel to the central axis of the cylindrical portion of the globe and are spaced circumferentially about the globe. The four circular wire rods 111–114 are spaced apart in the axial direction of the globe. The intersections of the rods are secured by welding.

The diameter of the enclosure formed by the circular rods 111–113 is slightly greater than the diameter of the cylindrical portion 107 of the globe. The diameter of the bottom circular rod 114 is slightly greater than the diameter of the bottom neck 109 and is less than the diameter of the cylindrical portion 107.

Figure 10:
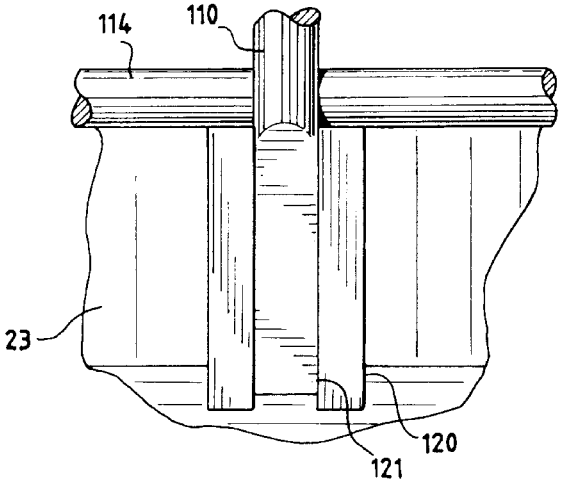
FIG. 10 is a fragmentary view taken along the line 10—10 of FIG. 9.

Referring to FIG. 8, the bottom of the ventilator cap 31 terminates in a cylindrical flange 115. The upper end of two diametrically opposed vertical rods 110 terminates in a circular eye or loop 116 which is positioned inwardly of the flange 115. The ventilator cap 31 is removably secured to the guard by a bale handle 117 (see also FIG. 10). The bail handle is formed from a generally U-shaped wire rod, and each end of the bail handle terminates in a laterally inwardly extending end portion 118 which extends through an opening 119 in the flange 115 and into one of the eyes 116.

When the globe/guard/ventilator cap assembly is attached to the burner assembly by the nut 106, the lantern can be lifted and carried by the bail handle 117. When the nut is unscrewed from the stud 105, the globe/guard/ventilator cap assembly can be removed as a unit by lifting the bail handle, the ventilator cap, or the guard. The bottom circular wire rod 114 engages the frusto-conical shoulder of the globe which extends between the cylindrical portion of the globe and the bottom neck 109 and lifts the globe with the guard. The globe is thereby protected by the guard both when the globe is mounted on the lantern and when the globe is removed from the lantern. The chance of accidental breakage of the globe is thereby reduced. More importantly, removal of the entire assembly provides improved access to the burner assembly for installation and removal of fragile mantles.

The globe can be removed from the guard by withdrawing the end portions 118 of the bail handle from the eyes 116. The bail handle is flexible, and the ends can be easily pulled apart to separate the end portions 118. The ventilator cap 31 can then be lifted away from the globe and guard, and the globe can be withdrawn upwardly from the guard.

Figure 9:
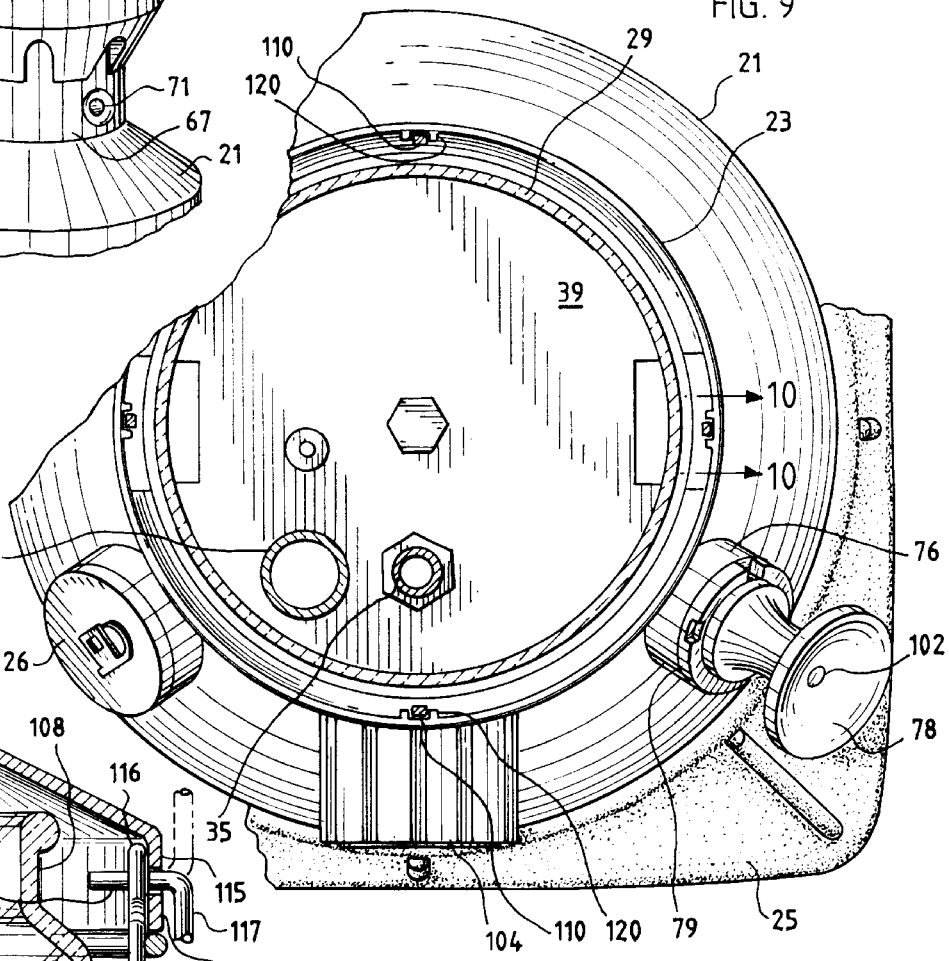
FIG. 9 is a fragmentary sectional view taken along the line 9—9 of FIG. 1.

When the globe/guard/ventilator cap assembly is mounted on the burner base 23 of the lantern, the assembly is prevented from rotating relative to the pan by a pair of vertical ribs 120 (FIGS. 9 and 10) on the inside surface of the base. The pair of ribs provides a channel 121 into which the bottom end of one of the vertical wire rods 110 extends. This assures that the bail when folded does not interfere with access to lantern controle and instruction. It also prevents rotation of the globe/guard/ventilator assembly relative the nut 106 which otherwise would cause the nut to disengage upon use.

Referring to FIG. 2, the molded elastomeric base 25 includes a generally cylindrical side wall 123 which fits snugly over the cylindrical side wall portion of the fuel tank 21 and a bottom flange 124 which extends laterally outwardly from the side wall 123. The bottom flange 124 is substantially flush with the bottom surface of the fuel tank and provides a wide, generally rectangular, stable support base for the lantern. The bottom flange 124 is reinforced by ribs 125 which are molded integrally with the bottom flange 124 and side wall 123.

If desired, the fill cap 26 of the fuel tank and the operating knob 104 of the fuel valve can be provided with icons or indicia which are molded integrally with the knobs. The icons or indicia provide visual information with respect to the function of the cap and the knob. For example, the fuel cap can bear the symbol of a gas pump. The operating knob can bear an arrow indicating the direction in which the knob is rotated to ignite the lantern and a symbol representing electronic ignition.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A lantern comprising:

a) a fuel tank, b) a burner assembly connected to the fuel tank, the burner assembly having:

i) a fuel tube communicating with the fuel tank and ii) a burner tube communicating with the fuel tube and having an outlet end c) an elongated tubular mantle having a pair of open ends, one of the open ends being releasably secured to the outlet end of the burner tube, and d) holding means on the lantern for holding the other open end of the mantle, the other open end of the mantle being releasably secured to the holding means.

2. The lantern of claim 1 in which the holding means comprises a generally cylindrical plug which closes the other open end of the mantle.

3. The lantern of claim 2 in which the general cylindrical plug is provided with an annular recess, and means for securing the mantle in the annular recess.

4. The lantern of claim 3 in which the securing means comprises a spring clip which surrounds the annular recess.

5. The lantern of claim 1 in which the distance between the outlet end of the burner tube and the holding means is at least about 3 inches.

6. The lantern of claim 1 in which the mantle includes a generally tubular side wall which includes a plurality of axially spaced accordion-shaped pleats.

7. The lantern of claim 1 in which the fuel tank is adapted to support the lantern on a horizontal surface and the burner assembly extends generally vertically upwardly above the fuel tank, the mantle extending generally vertically between the outlet end of the burner tube and the holding means.

8. The lantern of claim 1 including a spring clip for releasably securing said one open end of the mantle to the outlet end of the burner tube, the spring clip having a generally circular central portion which surrounds the outlet end of the burner tube and a pair of ends which extend generally radially outwardly from the central portion, the spring clip being secured around the outlet end of the burner tube by squeezing the ends of the clip together and securing the ends to reduce the diameter of the central portion.

9. The lantern of claim 8 including a second spring clip for releasably securing the other open end of the burner tube to the holding means, the second spring clip having a generally circular central portion which surrounds the holding means and a pair of ends which extend radially outwardly from the central portion, the second spring clip being secured around the holding means by squeezing the ends of the second clip together to reduce the diameter of the central portion.

10. In a lantern having:

a fuel tank adapted to support the lantern on a horizontal surface and having top and bottom portions, a support pan mounted above the fuel tank, a burner assembly extending upwardly from the support pan, a globe mounted on the support pan, and a cap mounted on the globe and removably attached to the burner assembly, the improvement comprising:

a wire guard surrounding the globe and extending between the support pan and the cap.

11. The lantern of claim 10 in which the wire guard is formed from a plurality of vertically spaced wire rods and a plurality of wire rods which are spaced circumferentially about the globe.

12. The lantern of claim 11 in which the support pan is provided with at least one vertically extending channel, at least one of the circumferentially spaced wire rods having a bottom end which is inserted into the channel.

13. The lantern of claim 10 in which the cap is attached to the wire guard whereby the cap and the wire guard can be removed as a unit.

14. The lantern of claim 13 including a bale handle having a pair of end portions which extend inwardly through openings in the cap and which are removably connected to the wire guard for attaching the cap to the wire guard whereby the cap can be removed from the wire guard by withdrawing the end portions of the handle from the openings in the cap.

15. The lantern of claim 10 in which the globe includes a generally cylindrical central portion and a bottom portion which has a smaller diameter than the central portion, the wire guard having a central portion which surrounds the central portion of the globe and a bottom portion which surrounds the bottom portion of the globe and which has a diameter smaller than the diameter of the central portion of the globe whereby when the cap is detached from the burner assembly, raising the wire guard from the collar raises the globe with the wire guard.

16. The lantern of claim 15 in which the cap is attached to the wire guard whereby the cap and the wire guard and the globe can be removed as a unit.

17. The lantern of claim 16 including a bale handle having a pair of end portions which extend inwardly through openings in the cap and which are removably connected to the wire guard for attaching the cap to the wire guard whereby the cap can be removed from the wire guard by withdrawing the end portions of the handle from the openings in the cap.

18. The lantern of claim 17 in which the wire guard is formed from a plurality of vertically spaced wire rods and a plurality of wire rods which are spaced circumferentially about the globe, two of the circumferentially spaced wire rods having upper ends which form loops, the inwardly extending ends of the handle extending through the loops.

19. The lantern of claim 18 including a nut rotatably mounted on the cap and a threaded fastener mounted on the burner assembly, the nut being threadedly engaged with the fastener.

20. The lantern of claim 15 including a nut rotatably mounted on the cap and a threaded fastener mounted on the burner assembly, the nut being threadedly engaged with the fastener.

21. In a liquid fuel lantern having a fuel tank and a burner assembly connected to the fuel tank, the improvement comprising an air pump for pressurizing the fuel tank, the air pump having an elongated barrel, a pump reciprocably mounted within the barrel, and a check valve mounted in an end of the barrel for allowing pressurized air to flow out of the barrel when the pump is moved toward the check valve and for sealing said end of the barrel when the pump is not moving toward the check valve.

22. The lantern of claim 21 in which the pump includes an elongated pump shaft having an inner end and an outer end which extends out of the barrel, a knob mounted on the outer end of the shaft for axial movement relative to the shaft between first and second positions, the outer end of the shaft projecting from the knob when the knob is in the second position, and means for biasing the knob to its first position until the pressure in the fuel tank reaches a predetermined level.

23. The lantern of claim 21 including a foam pad containing oil mounted in the barrel and surrounding the shaft for lubricating the pump cup as the shaft moves axially within the barrel.

24. In a liquid fuel lantern having a fuel tank and a burner assembly connected to the fuel tank, the improvement comprising an air pump for pressurizing the fuel tank, the air pump having an elongated barrel and an elongated pump shaft reciprocably mounted within the barrel, the pump shaft having an inner end and an outer end which extends out of the barrel, a knob mounted on the outer end of the shaft for axial movement relative to the shaft between first and second positions, the outer end of the shaft projecting from the knob when the knob is in the second position, and means for biasing the knob to its first position until the pressure in the fuel tank reaches a predetermined level.

25. The lantern of claim 24 including a pin extending through the knob and a shaft, the shaft having an opening larger than the pin whereby the knob can move axially between its first and second positions.

26. The lantern of claim 25 including a foam pad containing oil mounted in the barrel and surrounding the shaft for lubricating the pump cup as the shaft moves axially within the barrel.

27. In a liquid fuel lantern having a fuel tank and a burner assembly connected to the fuel tank, the fuel tank having a generally cylindrical side wall and a bottom wall, the improvement comprising a molded base having a generally cylindrical side wall which fits snugly around the generally cylindrical side wall of the fuel tank and a bottom flange which extends outwardly from the side wall of the base.

28. The lantern of claim 27 in which the base is molded integrally from elastomeric material.

29. The lantern of claim 27 in which the bottom flange of the base is substantially flush with the bottom wall of the fuel tank.

30. A lantern comprising:

a) a fuel tank, b) a burner assembly connected to the fuel tank, the burner assembly having:

i) a fuel tube communicating with the fuel tank and ii) a burner tube communicating with the fuel tube and having an outlet end, c) an elongated tubular mantle having a pair of opposing open ends and a pleated side wall, one of the open ends being releasably secured to the outlet end of the burner tube, and d) holding means on the lantern for holding the other end of the mantel, the other open end of the mantel being releasably secured to the holding means.

31. The lantern of claim 30 in which the holding means comprises a generally cylindrical plug which closes the other open end of the mantle.

32. The lantern of claim 31 in which the general cylindrical plug is provided with an annular recess, and the lantern further comprises means for securing the mantle in the annular recess.

33. The lantern of claim 32 in which the securing means comprises a spring clip which surrounds the annular recess.

34. The lantern of claim 30 in which the distance between the outlet end of the burner tube and the holding means is at least about 3 inches.

35. The lantern of claim 30 in which the side wall is a generally tubular side wall, which includes a plurality of axially spaced accordion-shaped pleats.

36. The lantern of claim 30 in which the fuel tank is adapted to support the lantern on a horizontal surface and the burner assembly extends generally vertically upwardly above the fuel tank, the mantle extending generally vertically between the outlet end of the burner tube and the holding means.

37. The lantern of claim 30 including a spring clip for releasably securing said one open end of the mantle to the outlet end of the burner tube, the spring clip having a generally circular central portion which surrounds the outlet end of the burner tube and a pair of ends which extend generally radially outwardly from the central portion, the spring clip being secured around the outlet end of the burner tube by squeezing the ends of the clip together and securing the ends to reduce the diameter of the central portion.

38. The lantern of claim 37 including a second spring clip for releasably securing the other open end of the burner tube to the holding means, the second spring clip having a generally circular central portion which surrounds the holding means and a pair of ends which extend radially outwardly from the central portion, the second spring clip being secured around the holding means by squeezing the ends of the second clip together to reduce the diameter of the central portion.

* * * * *